US009728884B1

(12) United States Patent
Sinha et al.

(10) Patent No.: US 9,728,884 B1
(45) Date of Patent: Aug. 8, 2017

(54) CONNECTOR

(71) Applicant: YAZAKI CORPORATION, Tokyo (JP)

(72) Inventors: Abhishek Kumar Sinha, Makinohara (JP); Yoshimi Wada, Mikinohara (JP); Naokazu Nagasaka, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/446,124

(22) Filed: Mar. 1, 2017

(30) Foreign Application Priority Data

Mar. 3, 2016 (JP) ..... 2016-041355

(51) Int. Cl.
*H01R 13/40* (2006.01)
*H01R 13/436* (2006.01)
*H01R 13/641* (2006.01)

(52) U.S. Cl.
CPC ..... *H01R 13/4364* (2013.01); *H01R 13/641* (2013.01)

(58) Field of Classification Search
CPC ..... H01R 13/4223; H01R 13/4365; H01R 13/4364; H01R 13/4362; H01R 13/641; H01R 13/4361; H01R 13/4368; H01R 13/4367; H01R 13/436; H01R 13/514
See application file for complete search history.

(56) References Cited

U.S. PATENT DOCUMENTS 5,967,859 A * 10/1999 Cecil, Jr. ..... H01R 13/4368 439/595
6,669,510 B2 * 12/2003 Yamawaki ..... H01R 13/639 439/357
9,306,326 B2 * 4/2016 Nishiyama ..... H01R 13/4362
2012/0156945 A1 * 6/2012 Matsumura ..... H01R 13/4364 439/744

FOREIGN PATENT DOCUMENTS

JP 2011-108576 A 6/2011

* cited by examiner

*Primary Examiner* — Xuong Chung Trans
(74) *Attorney, Agent, or Firm* — Sughrue Mion, PLLC

(57) ABSTRACT

A connector includes a housing including a terminal reception chamber in which a terminal can be received, and a front holder that is attached to the housing so as to double-lock the terminal in the terminal reception chamber, wherein the front holder includes a plate-like rib portion extending in a direction crossing a fitting direction of the front holder, the housing includes a groove portion and a mountain-like protrusion portion in a mounting position where the front holder is mounted, the groove portion being recessed into a shape that can receive the rib portion while supporting the rib portion, the groove portion extending in a direction in which the rib portion extends, the protrusion portion protruding in an extension direction of the groove portion and extending in the fitting direction of the front holder.

4 Claims, 17 Drawing Sheets

CONNECTOR

CROSS REFERENCE TO RELATED APPLICATION

This application is based on Japanese Patent Application No. 2016-041355 filed on Mar. 3, 2016, the contents of which are incorporated herein by reference.

BACKGROUND OF THE INVENTION

1. Technical Field

The present invention relates to a connector.

2. Background Art

There has been proposed a connector provided with a mechanism for detecting whether a terminal has been received normally in a terminal reception chamber or not (specifically whether there is or not a state in which the terminal has been inserted incompletely) and for more surely preventing the terminal received normally from coming off. For example, one of connectors in the background art (hereinafter referred to as "background-art connector") includes a housing having a terminal reception chamber, and a front holder attached to the housing from a front side of the housing (for example, see JP-A-2011-108576).

In the background-art connector, when a terminal has not been normally received in the terminal reception chamber (when the terminal has been inserted incompletely), the terminal pushes out a cantilever-like lance in the housing, and the lance is bent to enter a space in which a double-locking portion of the front holder should be inserted. Therefore, the front holder cannot be inserted to a final lock position. By use of this, it is detected whether there is or not a state in which the terminal has been inserted incompletely.

Further, in the background-art connector, the double-locking portion of the front holder pushes the lance toward the terminal in a state where the terminal has been normally received in the terminal reception chamber and the front holder has been attached to the final lock position. Thus, it is possible to obtain a double-locking state where the lance locks the terminal and the double-locking portion of the front holder locks the lance (in a normal position where a coming-off prevention function can be obtained).

Due to the double-locking state, the terminal normally received in the terminal reception chamber can be more surely prevented from coming off.

In the background-art connector, there is a certain gap between the front holder and the housing in the state where the front holder has been attached to the final lock position. Therefore, displacement of the front holder with respect to the housing (hereinafter referred to as "displacement of the front holder" simply) may cause rattling or the like in the front holder.

When the displacement of the front holder occurs, the lance may be released from being locked by the front holder (that is, the double-locking state may be canceled). Accordingly, the terminal may be unintentionally released from being locked by the lance. In that case, displacement also occurs in the terminal inside the housing. As a result, there is a possibility that electric connection between the connector and another connector may be incomplete. From the point of view of reliability in the electric connection, it is therefore preferable that the displacement of the front holder is prevented as much as possible.

The present invention has been developed in consideration of the aforementioned situation. An object of the invention is to provide a connector capable of preventing displacement of a front holder as much as possible.

SUMMARY OF INVENTION (1) According to an aspect of the invention, a connector includes:

a housing including a terminal reception chamber in which a terminal can be received; and a front holder that is attached to the housing so as to double-lock the terminal in the terminal reception chamber, wherein the front holder includes a plate-like rib portion extending in a direction crossing a fitting direction of the front holder, the housing includes a groove portion and a mountain-like protrusion portion in a mounting position where the front holder is mounted, the groove portion being recessed into a shape that can receive the rib portion while supporting the rib portion, the groove portion extending in a direction in which the rib portion extends, the protrusion portion protruding in an extension direction of the groove portion and extending in the fitting direction of the front holder, and when the front holder is attached to the housing, the rib portion is received in the groove portion, and the protrusion portion comes in contact with a surface of the front holder.

(2) A connector according to the aforementioned configuration (1), wherein the housing including the protrusion portion further includes other protrusion portions similar thereto, and the protrusion portions are disposed in contact with at least three places of the front holder including a central part in a width direction of the front holder, a part on one end side from the central part, and a part on the other end side from the central part.

(3) A connector according to the aforementioned configuration (1) or (2), wherein the rib portion has a sectionally flat shape in a section perpendicular to the extension direction of the rib portion, the flat shape being long in the fitting direction and short in the width direction of the front holder.

According to the connector having the aforementioned configuration (1), the rib portion of the front holder is received and supported in the groove portion of the housing in the state where the front holder has been attached to the housing. Thus, the housing is suppressed from moving in a direction crossing an extension direction of the rib portion (for example, in the width direction of the housing when the rib portion extends in a height direction of the housing) and from twisting to tilt an axis of the rib portion.

Further, the protrusion portion of the housing is in contact with the surface of the front holder in the state where the front holder has been attached to the housing. Thus, the housing is suppressed from moving in the extension direction of the groove portion (identical to the extension direction of the rib portion, and, for example, the height direction of the housing when the rib portion extends in the height direction of the housing) and from twisting to tilt the housing in the fitting direction. Incidentally, moving of the front holder in a front/rear direction (fitting direction) can be prevented by contact between the front holder of the connector and a front holder provided in a mating connector.

As a result, in the connector having the configuration, the housing can be suppressed from moving and twisting, as compared with a background-art connector. Therefore, in the connector having the configuration, displacement of the front holder can be prevented as much as possible.

According to the connector having the aforementioned configuration (2), the protrusion portions provided in the housing are in contact with the front holder at the central part and the parts on the opposite sides thereof in the width direction of the front holder in the state where the front holder has been attached to the housing. Thus, not only can twisting of the housing can be suppressed by the rib portion as described above, but the twisting of the housing can be also suppressed by the protrusion portions. Therefore, in the connector having the configuration, displacement of the front holder can be prevented more surely.

According to the connector having the aforementioned configuration (3), due to the sectionally flat shape of the rib portion, the front holder can be more surely prevented from twisting to rotate around the axis of the rib portion. Thus, displacement of the front holder can be prevented more surely.

Advantage of the Invention

According to the invention, it is possible to provide a connector capable of preventing displacement of a front holder as much as possible.

The invention has been described briefly above. The further details of the invention will be made clearer if the following Mode for Carrying Out the Invention (hereinafter referred to as "embodiment") is read through with reference to the accompanying drawings.

BRIEF DESCRIPTION OF DRAWINGS

FIG. 2A shows a state in which the front holder is in the middle of being inserted (a state in which the front holder is in a "temporary" lock position), and FIG. 2B shows a state in which the front holder has been completely inserted (a state in which the front holder is in a "final" lock position).

FIG. 4A is a sectional view taken on line A-A of FIG. 3, and FIG. 4B is a sectional view taken on line B-B of FIG. 3.

FIG. 5A is a sectional view taken on line A-A of FIG. 3, and FIG. 5B is a sectional view taken on line B-B of FIG. 3.

FIG. 7A is a sectional view taken on line C-C and showing a state in which a male-side front holder is being inserted, and FIG. 7B is a sectional view taken on line C-C of FIG. 6 and showing a state in which the male-side front holder has been completely inserted.

FIG. 9A is a perspective view of the female-side front holder, and FIG. 9B is a sectional view taken on line D-D of FIG. 9A.

FIG. 10A is a perspective view of the female housing, and FIG. 10B is a sectional view taken on line E-E of FIG. 10A.

FIG. 12A is a view in which the female housing is viewed from the front, FIG. 12B is an enlarged view of a region F near the protrusion portion, and FIG. 12C is a sectional view taken on line G-G of FIG. 12A.

FIG. 13A is a view showing a state in which the female-side front holder is being inserted, and FIG. 13B is a view showing a state in which the female-side front holder has been completely inserted.

FIG. 16A is a perspective view in which the male housing is viewed obliquely from the front, and FIG. 16B is an enlarged view of a region H near a deepest portion of the guide groove.

FIG. 17A is a front view of the male housing, FIG. 17B shows a state in which a removal jig is inserted along the guide groove in a sectional view taken on line I-I, and FIG. 17C shows a state in which the front holder is pulled out by the removal jig hooked on the front holder in the sectional view taken on line I-I.

DETAILED DESCRIPTION OF EMBODIMENTS

A connector according to an embodiment of the invention will be described below with reference to the drawings. Incidentally, in all the drawings which will be described below, terminals and electric wires extending from the terminals are omitted from illustration for simplification or the like of explanation of respective members.

(Overall Configuration)

Figure 1:
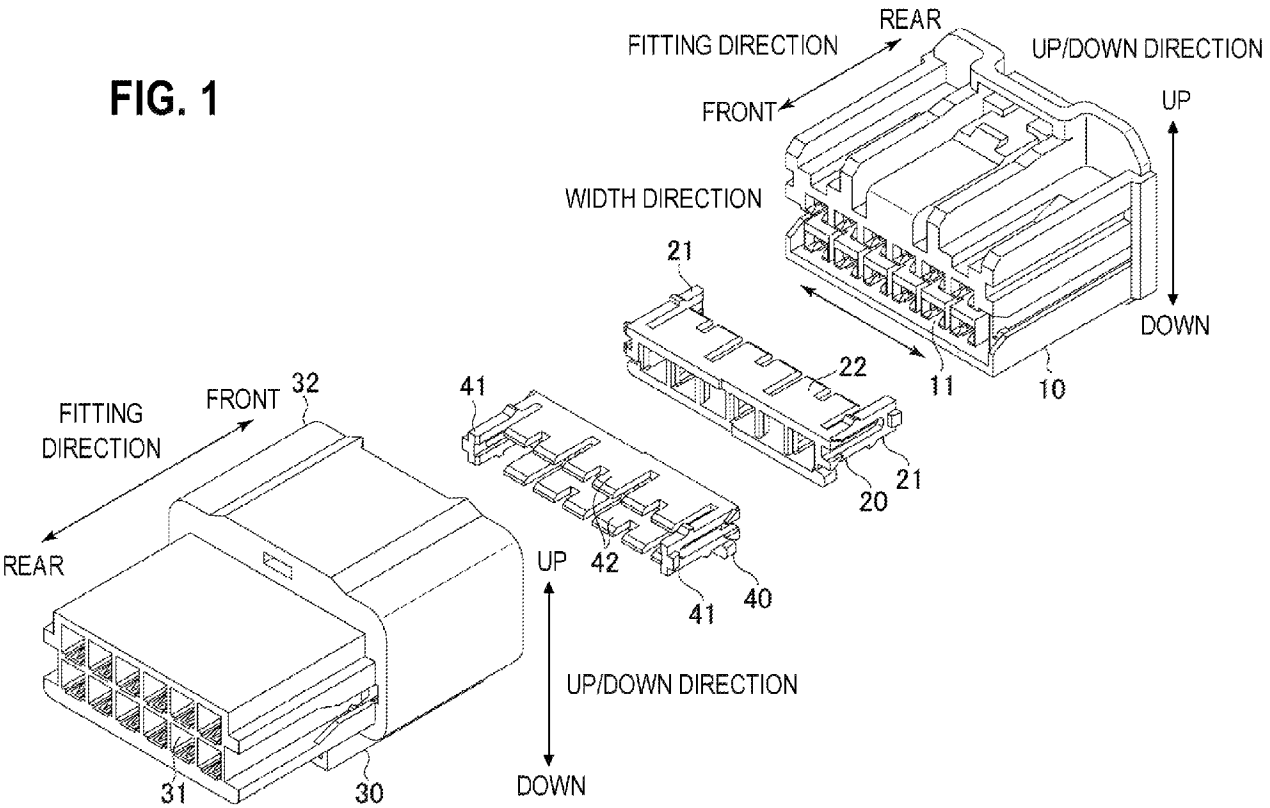
FIG. 1 is a schematic perspective view of a connector according to an embodiment of the invention.

As shown in FIG. 1, the connector according to the embodiment of the present invention is constituted by a female housing 10, a female-side front holder (hereinafter referred to as "front holder" simply) 20, a male housing 30, and a male-side front holder (hereinafter referred to as "front holder" simply) 40. A "fitting direction", a "width direction", an "up/down direction", a "front", a "rear", an "up" and a "down" will be defined as shown in FIG. 1. The "fitting direction", the "width direction" and the "up/down direction" are directions perpendicular to one another.

Inside the female housing 10, a plurality (12 in total including 6 in the width direction and 2 in the up/down direction in the embodiment) of terminal reception chambers 11 are formed in the fitting direction. In the female housing 10, a plurality (12 in the embodiment) of female terminals connected to end portions of a plurality of electric wires respectively are inserted into corresponding ones of the terminal reception chambers 11 respectively from the rear side. After that, the front holder 20 is mounted from the front side.

The front holder 20 has a pair of arms 21 and a plurality (12 in the embodiment) of flat-plate-like double locking portions 22. The arms 21 protrude rearward in opposite end portions in the width direction. The double locking portions 22 protrude rearward in positions corresponding to the terminal reception chambers 11 respectively. As will be described later, the pair of arms 21 and the plurality of double locking portions 22 have a function of detecting whether female terminals have been normally received in the terminal reception chambers 11 or not (specifically whether there is or not a state in which the female terminals have been inserted incompletely), and a function of more surely preventing the female terminals received normally from coming off.

Inside the male housing 30, a plurality (12 in total including 6 in the width direction and 2 in the up/down direction in the embodiment) of terminal reception chambers 31 are formed in the fitting direction in the same manner as in the female housing 10. In the male housing 30, a plurality (12 in the embodiment) of male terminals connected to end portions of a plurality of electric wires respectively are inserted into corresponding ones of the terminal reception chambers 31 respectively from the rear side. After that, the front holder 40 is mounted from the front side. A cylindrical enclosure portion (hollow portion) 32 enclosing front end portions (tap portions) of the male terminals is provided integrally on the front side of the male housing 30 for the sake of protection or the like of the front end portions of the male terminals.

The front holder 40 has substantially the same shape as the front holder 20. That is, the front holder 40 has a pair of arms 41 and a plurality (12 in the embodiment) of flat-plate-like double locking portions 42. The arms 41 protrude rearward in opposite end portions in the width direction. The double locking portions 42 protrude rearward in positions corresponding to the terminal reception chambers 31 respectively. The pair of arms 41 and the plurality of double locking portions 42 have a function of detecting whether male terminals have been normally received in the terminal reception chambers 31 or not (specifically whether there is or not a state in which the male terminals have been inserted incompletely), and a function of more surely preventing the male terminals received normally from coming off.

In this manner, the front holder 20 and the front holder 40 have substantially the same shape (their shapes will be described later in detail. For example, see FIG. 9 and FIG. 14). Therefore, the front holder 20 can be attached to the male housing 30 in place of the front holder 40. Conversely, the front holder 40 can be attached to the female housing 10 in place of the front holder 20. That is, the front holder 20 and front holder 40 can be shared with each other.

Figure 2A:
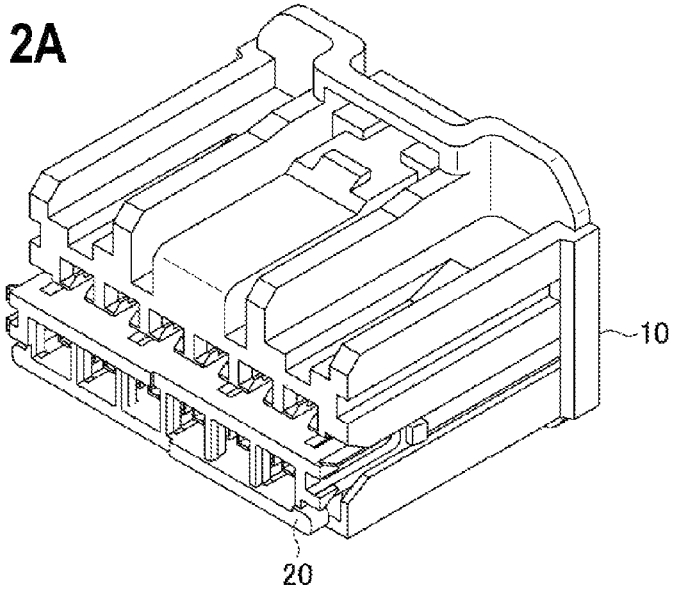
FIGS. 2A and 2B are views each showing a state in which a female-side front holder is attached to a female housing shown in FIG. 1.
Figure 2B:
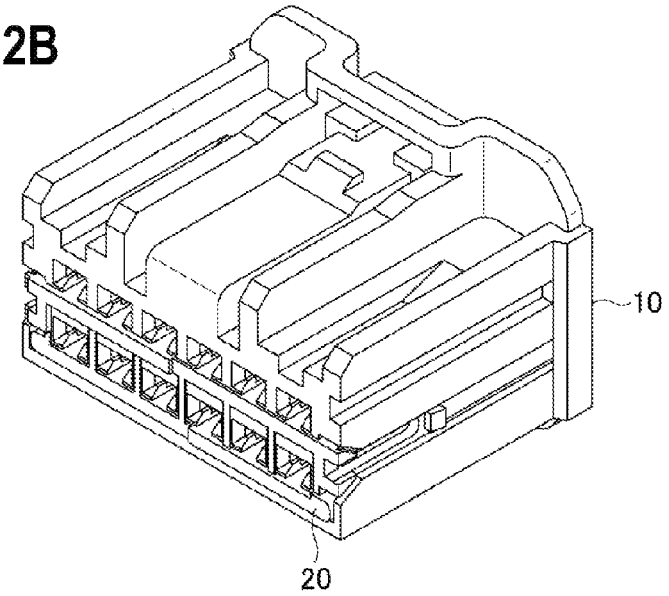

As shown in FIG. 2(*a*) and FIG. 2(*b*), the front holder 20 is inserted into the female housing 10 from the front side, and inserted up to a "final" lock position (where the front holder 20 has been completely inserted) shown in FIG. 2(*b*) through a "temporary" lock position (where the front holder 20 has been inserted incompletely) shown in FIG. 2(*a*).

Figure 3:
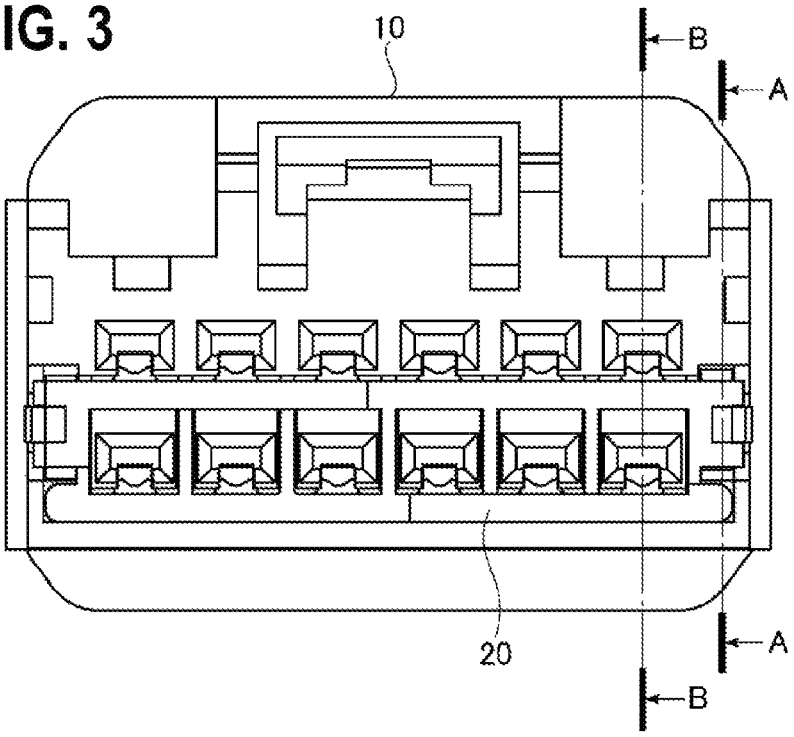
FIG. 3 is a view in which the female housing shown in FIG. 1 is viewed from a front side.
Figure 4A:
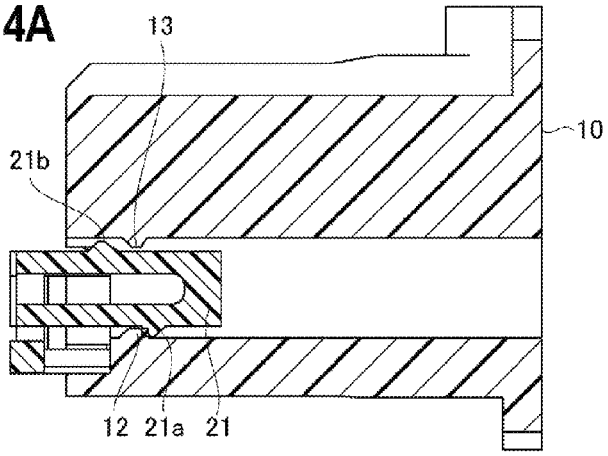
FIGS. 4A and 4B are sectional views showing the state (the state of FIG. 2A) in which the female-side front holder is being inserted into the female housing shown in FIG. 1.
Figure 4B:
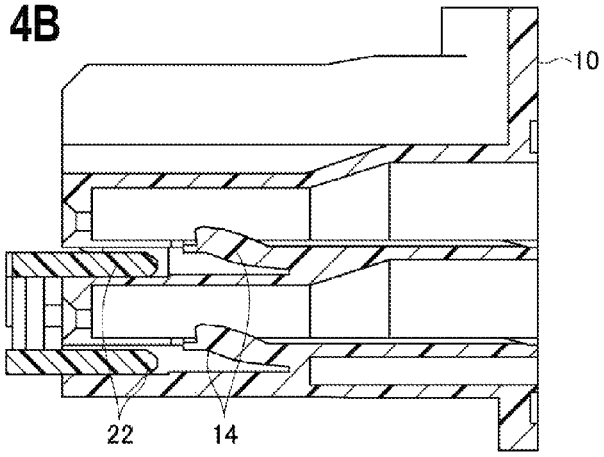

As shown in FIG. 4(*a*) (a sectional view taken on line A-A in FIG. 3), in the state where the front holder 20 is in the "temporary" lock position shown in FIG. 2(*a*), a protrusion 21*a* (also see FIG. 9) provided in each arm 21 has gotten over a protrusion 12 provided in the female housing 10 while a protrusion 21*b* (also see FIG. 9) provided in the arm 21 has not gotten over a protrusion 13 (also see FIG. 9) provided in the female housing 10 yet. Thus, the front holder 20 can be retained in the "temporary lock position" as long as no external force acts thereon.

In addition, as shown in FIG. 4(*b*) (a sectional view taken on line B-B in FIG. 3), in the state where the front holder 20 is in the "temporary" lock position, the double locking portions 22 have not reached lances 14 provided in the female housing 10 yet. The lances 14 are provided correspondingly to the terminal reception chambers 11 respectively.

Each lance 14 is a locking piece extending frontward and obliquely upward. A front end portion of the lance 14 enters the inside of the corresponding terminal reception chamber 11 from an opening portion formed in a lower surface of the terminal reception chamber 11. In a state where a female terminal has been normally received in the terminal reception chamber 11, the front end portion of the lance 14 locks a locking portion of the female terminal received in the terminal reception chamber 11 so that the female terminal can be prevented from coming off.

On the contrary, in a state where the female terminal has not been normally received in the terminal reception chamber 11 (in a state where the female terminal has been inserted incompletely), the female terminal pushes down the lance 14 so that the lance 14 can be bent to enter a space where the corresponding double locking portion 22 should be inserted. Therefore, the front holder 20 cannot be inserted to the "final" lock position. By use of this, it is possible to detect whether there is or not a state where the female terminal has been inserted incompletely.

Figure 5A:
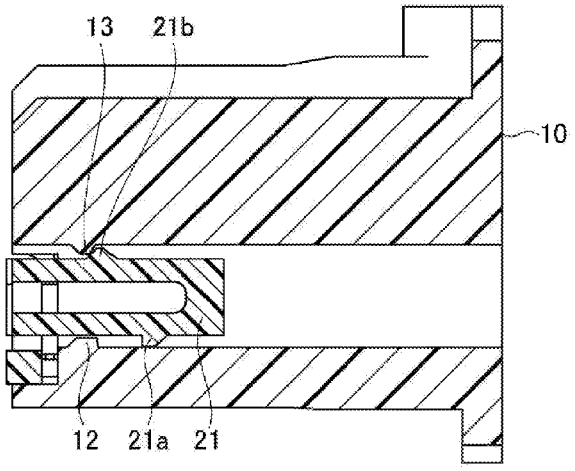
FIGS. 5A and 5B are sectional views showing the state (the state of FIG. 2B) in which the female-side front holder has been completely inserted into the female housing shown in FIG. 1.
Figure 5B:
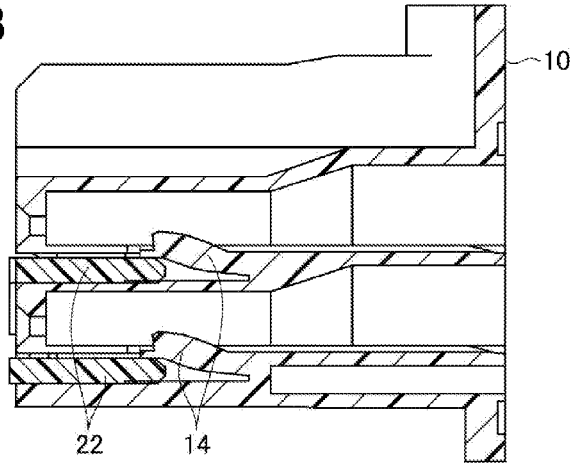

In the state where the front holder 20 is in the "final" lock position shown in FIG. 2(*b*) (and in the state where the female terminal has been normally received in the terminal reception chamber 11), the protrusion 21*b* has gotten over the protrusion 13 as shown in FIG. 5(*a*) (a sectional view taken on line A-A in FIG. 3). In addition, as shown in FIG. 5(*b*) (a sectional view taken on line B-B in FIG. 3), the double locking portion 22 enters the apace under the lance 14 so as to push the lance 14 toward the female terminal (upward). Thus, it is possible to obtain a so-called double-locking state in which the lance 14 locks the female terminal and the double locking portion 22 locks the lance 14 (in a normal position where the coming-off preventing function can be obtained). Due to the double-locking state, the female terminal normally received in the terminal reception portion 11 can be more surely prevented from coming off.

In this manner, in the state where the front holder 20 is in the "final" lock position, the front holder 20 can be retained in the "final" lock position as long as no external force acts thereon.

In the same manner as the front holder 20, the front holder 40 is, though not shown, also inserted into the male housing 30 from the front side, and inserted up to a "final" lock position (where the front holder 40 has been inserted completely) through a "temporary" lock position (where the front holder 40 has been inserted incompletely).

Figure 6:
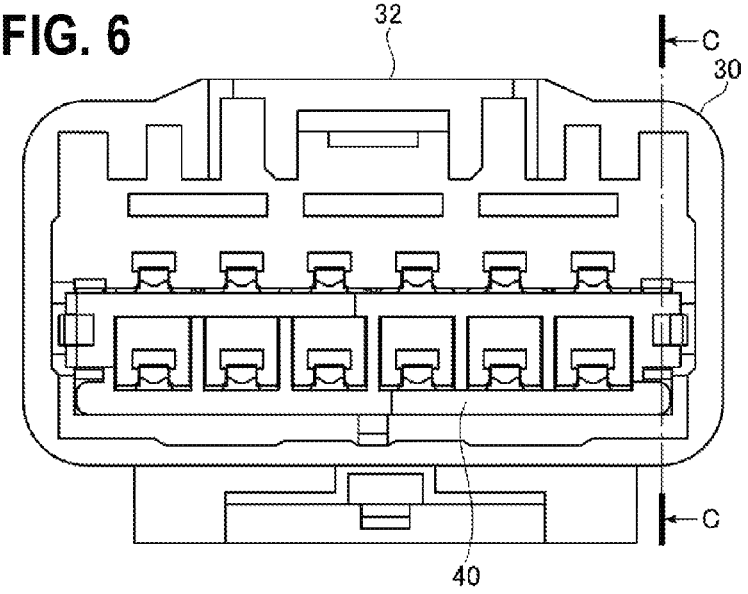
FIG. 6 is a view in which a male housing shown in FIG. 1 is viewed from the front side.
Figure 7A:
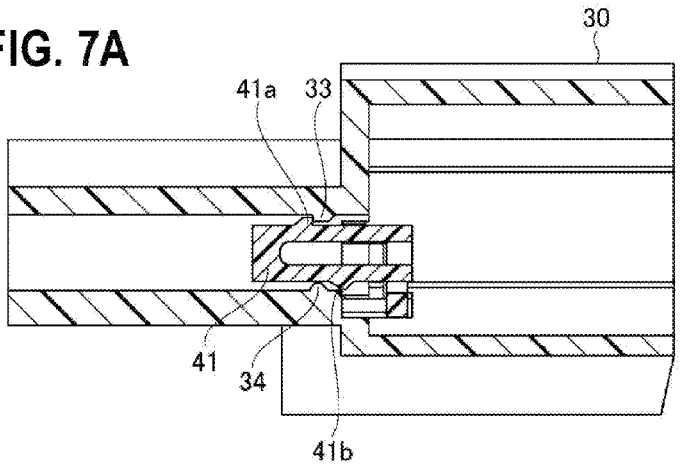
FIGS. 7A and 7B are sectional views showing the male housing shown in FIG. 1.
Figure 7B:
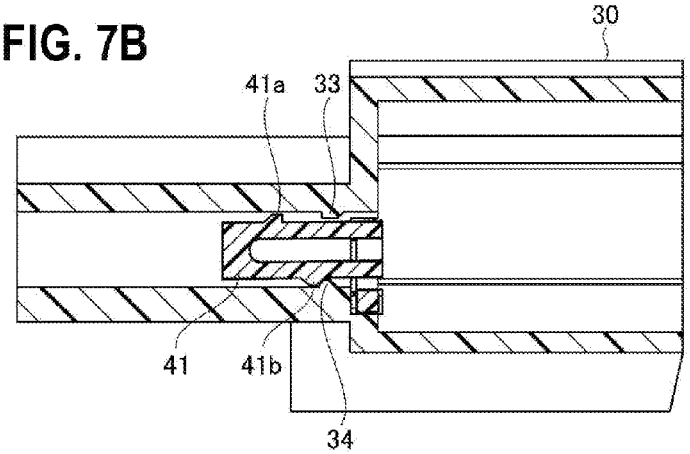

In the state where the front holder 40 is in the "temporary" lock position, as shown in FIG. 7(*a*) (a sectional view taken on line C-C in FIG. 6), a protrusion 41*a* provided in each arm 41 has gotten over a protrusion 33 provided in the male housing 30 while a protrusion 41*b* provided in the arm 41 has not gotten over a protrusion 34 provided in the male housing 30 yet. Thus, the front holder 40 can be retained in the "temporary lock position as long as no external force acts thereon. In addition, though not shown, each double locking portion 42 has not reached a position of a corresponding lance provided in the male housing 30.

On the other hand, in the state where the front holder 40 is in the "final" lock position (and in the state where the male terminal has been normally received in the terminal reception chamber 31), the protrusion 41*b* has gotten over the protrusion 34 as shown in FIG. 7(*b*) (a sectional view taken on line C-C in FIG. 6). In addition, though not shown, each double locking portion 42 enters a space under a corresponding lance to push the lance toward the male terminal (upward). Thus, the front holder 40 can be retained in the "final" lock position as long as no external force acts thereon.

In the same manner as the case of the lance 14 provided in the female housing 10 and the double locking portion 22 of the front holder 20, whether there is or not a state in which the male terminal has been inserted incompletely can be detected by the cooperation between the lance provided in the male housing 30 and the double locking portion 42 of the front holder 40. In addition, due to the double-locking state, the male terminal normally received in the terminal reception chamber 31 can be more surely prevented from coming off.

Figure 8:
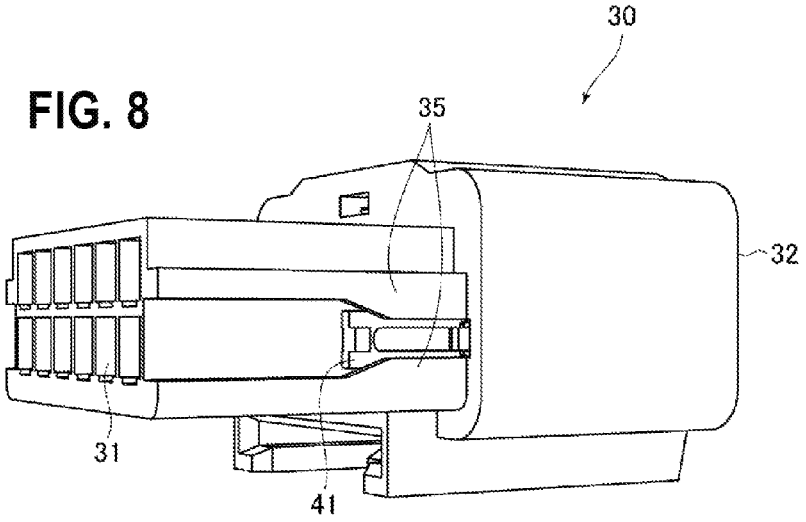
FIG. 8 is a perspective view in which the male housing shown in FIG. 1 is viewed obliquely from the rear.

In addition, as shown in FIG. 8, in the state where the front holder 40 is in the "final" lock position, only a front end part of each arm 41 of the front holder 40 is exposed from an inclined end face of the cover 35 attached to the male housing 30. Thus, when the arm 41 is pushed out to separate the front holder 40 from the male housing 30, the work of pushing out the arm 41 can be performed easily. On the other hand, when such separation is not required (for example, in normal use), a hand or the like of a worker can be prevented from touching the arm 41 unintentionally.

(Detailed Shapes of Front Holder and Position of Housing where Front Holder is Mounted)

Next, description will be made about detailed shapes of the front holder 20 and the position of the female housing 10 where the front holder is mounted.

Figure 9A:
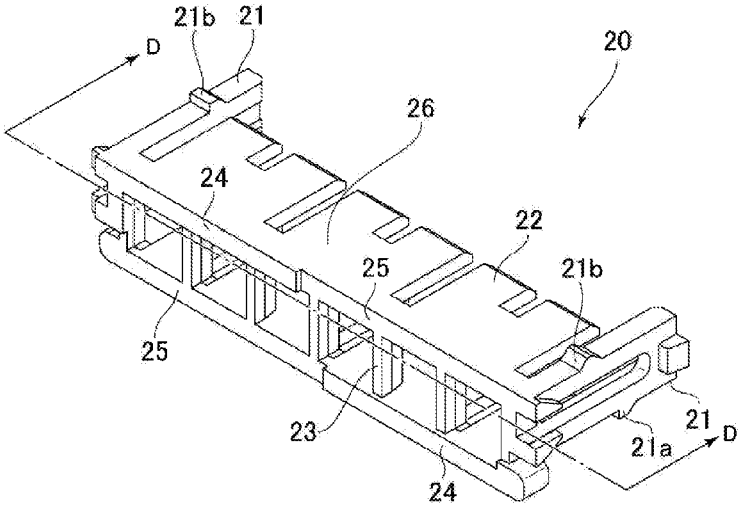
FIGS. 9A and 9B show the female-side front holder shown in FIG. 1.

As shown in FIG. 9, the front holder 20 has a plurality (five in the embodiment) of plate-like ribs 23 inside a frame portion 26 having a quadrangular shape in section. The ribs 23 connect an upper wall and a lower wall of the frame portion 26 with each other in the up/down direction. To say other words, each rib 23 extends in a direction crossing the fitting direction of the front holder 20. The ribs 23 are provided in corresponding positions between adjacent ones of a plurality (six in the embodiment) of terminal reception chambers 11 in the width direction respectively. As shown in FIG. 9(*b*) (a sectional view taken on line D-D in FIG. 9(*a*)), a section (section along a plane parallel to the fitting direction and the width direction) of each rib 23 perpendicular to the extension direction thereof (up/down direction) has a flat shape long in the fitting direction and short in the width direction. Incidentally, the aforementioned pair of arms 21 protrude rearward from opposite side walls of the frame portion 26 in the width direction respectively, and the aforementioned plurality of double locking portions 22 protrude rearward from the upper and lower walls of the frame portion 26 respectively.

In addition, front end faces of the front holder 20 (more specifically, front faces of the upper and lower walls of the frame portion 26) are formed to be stepped by convex portions 24 and concave portions 25. In the embodiment, a convex portion 24 and a concave portion 25 are formed on one side and the other side in the width direction in the upper wall front face of the frame portion 26 respectively, and a concave portion 25 and a convex portion 24 are formed on one side and the other side in the width direction in the lower wall front face of the frame portion 26 respectively. Incidentally, the front holder 40 has substantially the same shape as the front holder 20 (also see FIG. 14).

Figure 10A:
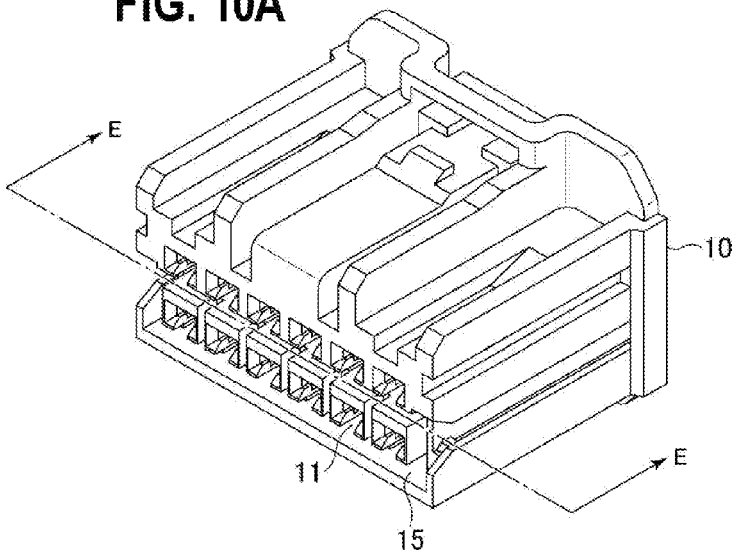
FIGS. 10A and 10B show the female housing shown in FIG. 1.
Figure 10B:
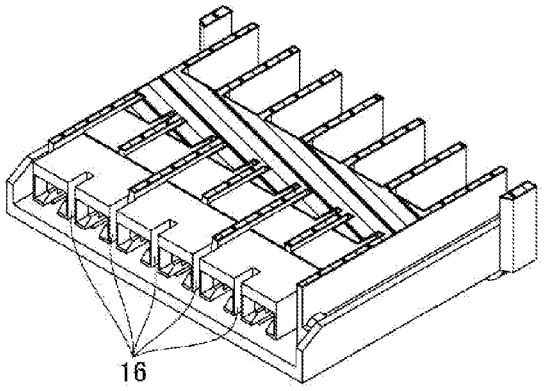

As shown in FIG. 10, a front end portion of the female housing 10 serves as a front holder mounting position 15. In the front holder mounting position 15, as shown in FIG. 10(*b*), groove portions 16 extending in the up/down direction and opened on the front side are provided in a plurality (five in the embodiment) of positions corresponding to the positions of a plurality (five in the embodiment) of ribs 23 in the width direction respectively. Each groove portion 16 is recessed in a shape capable of receiving a corresponding one of the aforementioned ribs 23 while supporting the rib 23. In addition, the groove portion 16 extends in a direction in which the rib 23 extends.

In the state where the front holder 20 has been attached to the female housing 10 so as to reach the "final" lock position, the ribs 23 of the front holder 20 are inserted into and supported by the corresponding groove portions 16 respectively. Thus, it is possible to suppress moving and twisting of the front holder 20 in the width direction.

Figure 11:
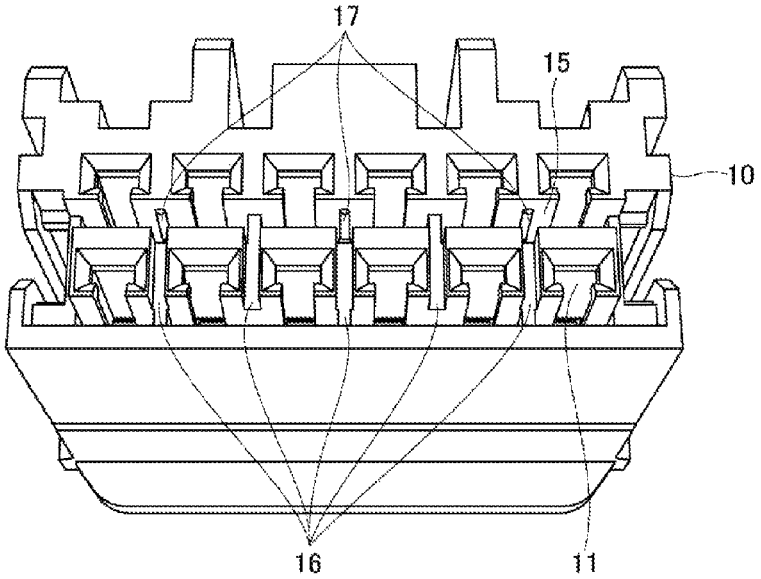
FIG. 11 is a perspective view in which the female housing shown in FIG. 1 is viewed obliquely from below.

As shown in FIG. 11, mountain-like protrusion portions 17 protruding downward (in the extension directions of the groove portions 16) and extending in the fitting direction of the front holder 20 are formed on an upper face of the front holder mounting position 15 of the female housing 10. In the embodiment, the protrusion portions 17 are formed at three places in the width direction respectively.

Figure 12A:
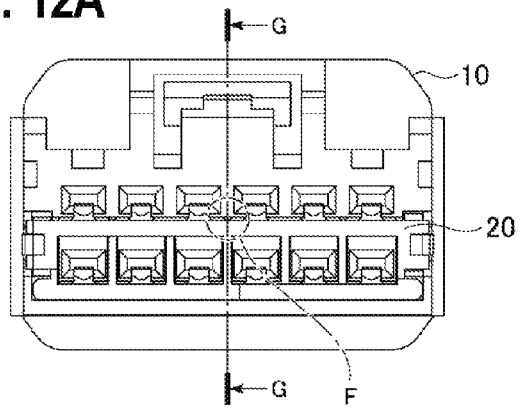
FIGS. 12A to 12C are views for explaining a protrusion portion provided in the female housing shown in FIG. 1.
Figure 12B:
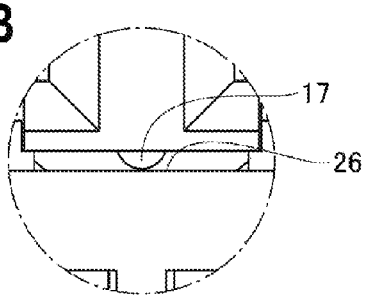
Figure 12C:
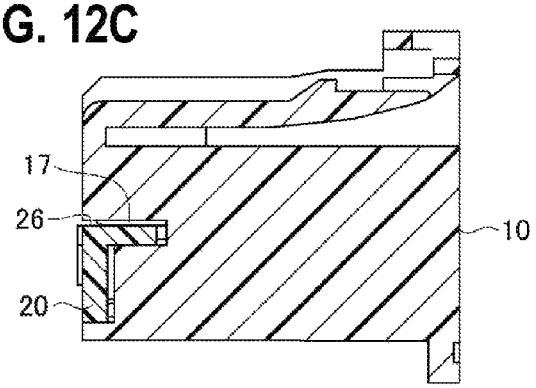

In the state where the front holder 20 has been attached to the female housing 10 so as to reach the "final" lock position, as shown in FIG. 12, the three protrusion portions 17 touch three places in the upper face of the upper wall of the frame portion 26 of the front holder 20, that is, a central part in the width direction, a part on one side in the width direction from the central part, and a part on the other side in the width direction from the central part respectively. Thus, it is possible to suppress moving and twisting of the front holder 20 in the up/down direction.

Figure 13A:
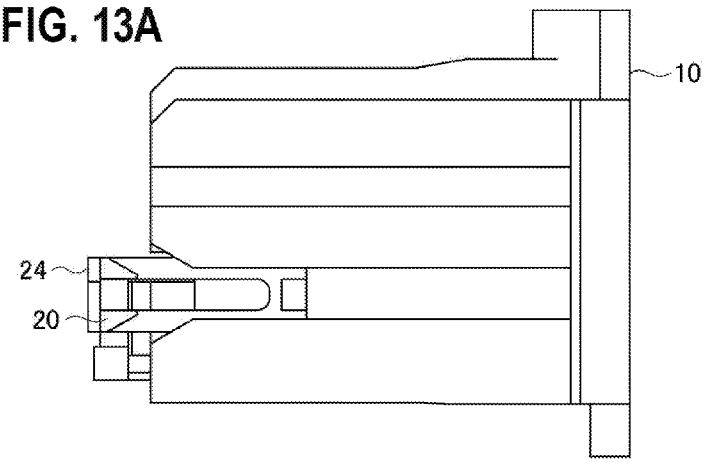
FIGS. 13A and 13B show states in which the female-side front holder is attached to the female housing shown in FIG. 1.
Figure 13B:
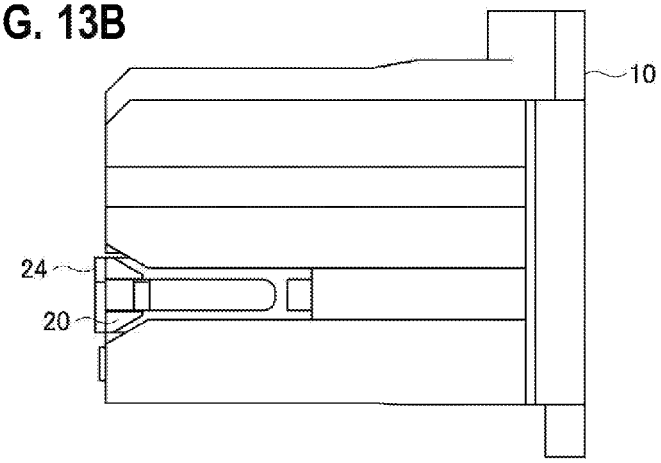

As shown in FIG. 13, in the state where the front holder 20 has been attached to the female housing 10 so as to reach the "final" lock position, the convex portion 24 (also see FIG. 9) in each front end face of the front holder 20 protrudes from the front end face of the female housing 10. Thus, the following operation and effect can be obtained.

That is, when the female terminal has been inserted incompletely, the lance 14 is bent downward so that the front holder 20 cannot move from the "temporary" lock position to the "final" lock position, as described above. As a result, the front end face of the front holder 20 is normally protruded from the front end face of the female housing 10.

However, due to a variation in dimensional accuracy or the like of the female housing 10 and the front holder 20, there is a case where the front holder 20 can move to a position close to the "final" lock position in spite of the state where the female terminal has been inserted incompletely. In this case, there may arise a possibility that the front end face of the front holder 20 may appear not to protrude from the front end face of the female housing 10 in spite of the state where the female terminal has been inserted incompletely. As a result, a worker may be unaware of the state where the female terminal has been inserted incompletely.

However, each front end face of the front holder 20 is formed to be stepped by the convex portion 24 and the concave portion 25. Accordingly, even in the case where the front holder 20 has moved to a position close to the "final" lock position, forward protrusion of the front holder 20 is more conspicuous than in a case where the front end face of the front holder is flat. As a result, the worker is easily aware of the state where the female terminal has been inserted incompletely.

The detailed shape of the front holder 20 and the female housing 10 have been described above. In the front holder 40, ribs, convex portions 43 and concave portions 44 are also formed correspondingly to the ribs 23, the convex portions 24 and the concave portions 25 of the front holder 20 respectively (also see FIG. 14). In addition, in the male housing 30, though not shown, grooves and protrusion portions are also formed correspondingly to the groove portions 16 and the protrusion portions 17 of the female housing 10 respectively.

Thus, also in the relationship between the front holder 40 and the male housing 30, moving and twisting of the front holder 40 in the width direction and moving and twisting of the front holder 40 in the up/down direction can be suppressed in the same manner as in the relationship between the front holder 20 and the female housing 10, as described above. In addition, when the male terminal has been inserted incompletely, forward protrusion of the front holder 40 is so conspicuous that the worker can be easily aware of the state where the male terminal has been inserted incompletely.

Figure 14A:
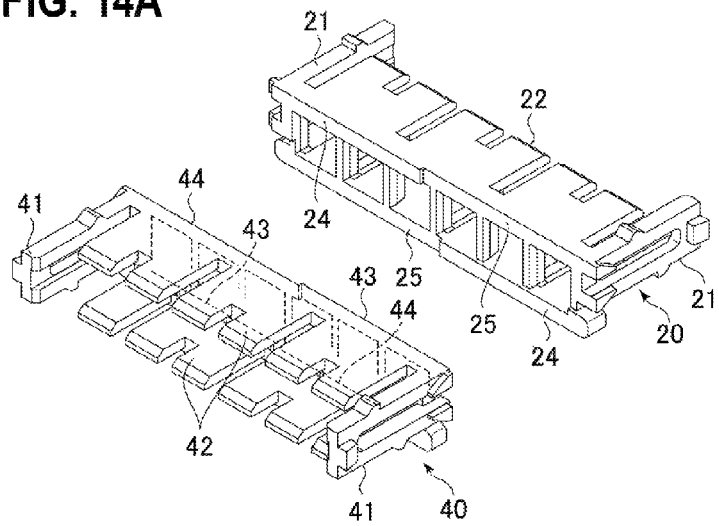
FIG. 14A shows a state in which the male-side front holder and the female-side front holder shown in FIG. 1 approach each other and face each other when the male housing and female housing are fitted to each other (when the connectors are fitted to each other), and FIG. 14B includes a top view and a bottom view of the female-side front holder.
Figure 14B:
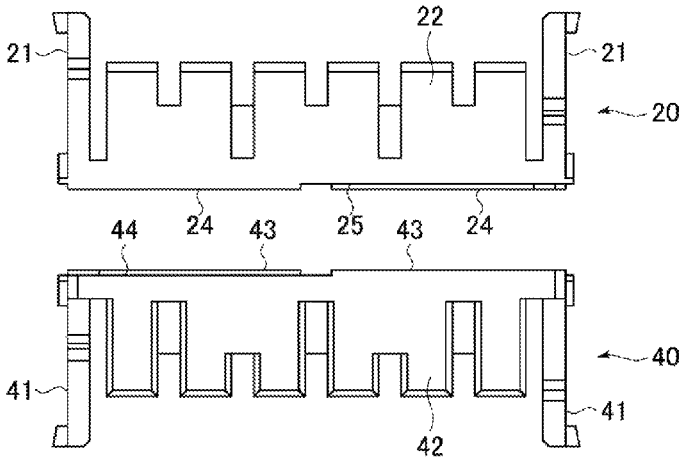

The front holder 40 also has substantially the same shape as the front holder 20, as described above. Accordingly, as shown in FIG. 14, front end faces of the front holder 40 are formed to be stepped by the convex portions 43 and the concave portions 44 in the same manner as those of the front holder 20.

Figure 15:
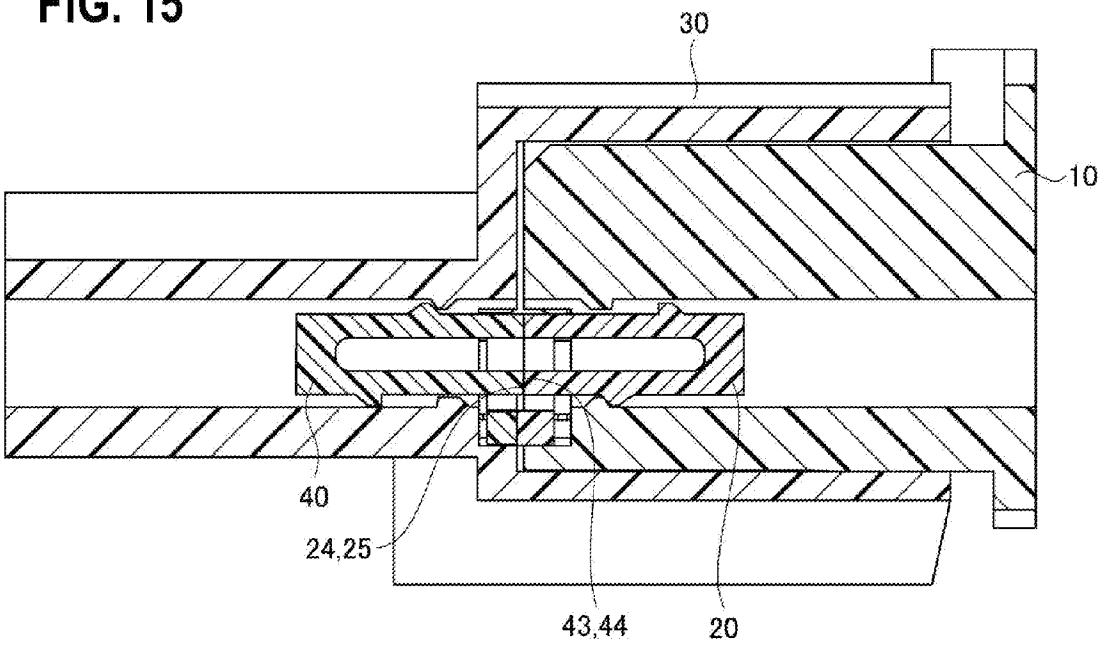
FIG. 15 is a schematic view showing a state in which the male housing and the female housing shown in FIG. 1 have been fitted to each other.

As shown in FIG. 15, the front end faces of the front holder 20 are in contact with the front end faces of the front holder 40 in a state (connector fitting completion state) where the female housing 10 and the male housing 30 have been completely fitted to each other. In this state, the convex portions 24 and the concave portions 25 on the front holder 20 side are in contact with the concave portions 44 and the convex portions 43 on the front holder 40 side respectively.

Here, when simple convex portions are provided in front end faces of a front holder, length of the front holder is increased in the fitting direction, and hence total length of a connector (=female housing+male housing) is increased. On the other hand, the convex portions and the concave portions are provided to be stepped in the front end faces of both the front holder 20 and the front holder 40. When the female housing 10 and the male housing 30 have been completely fitted to each other, the convex portions are in contact with the concave portions respectively between the front holders. Thus, in spite of the convex portions provided in the front end faces of the front holders, it is possible to suppress increase in size of the connector.

Further, as described above, the front holder 20 and the front holder 40 have substantially the same shape. Therefore, the front holder 20 and the front holder 40 can be shared with each other. As a result, the number of components in the connector can be reduced, as compared with a case where the front holder 20 and the front holder 40 cannot be shared (that is, a case where the front holder 20 and the front holder 40 have different shapes). Thus, management or the like of the components can be made easily during manufacturing of the connector. In addition, it is not necessary to prepare individual (different) molds for manufacturing the front holders 20 and 40 respectively. It is therefore possible to reduce the manufacturing cost of the front holders 20 and 40, and hence it is possible to reduce the manufacturing cost of the connector.

(To Make it Easy to Remove Front Holder from Male Housing)

Next, description will be made about making it easy to remove the front holder 40 from the male housing 30.

Figure 16A:
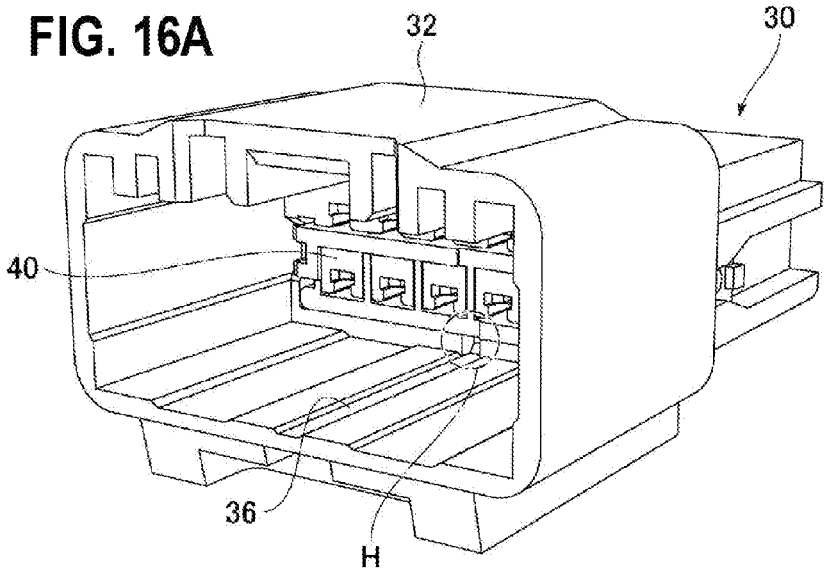
FIGS. 16A and 16B are views for explaining a guide groove provided in the male housing shown in FIG. 1.
Figure 16B:
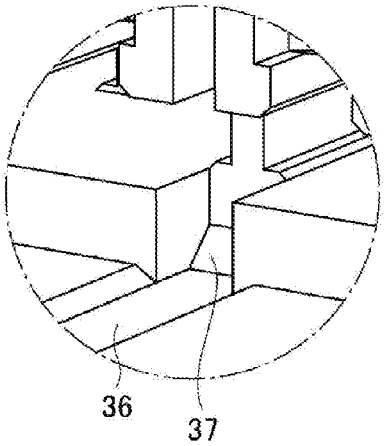

As shown in FIG. 16, a cylindrical enclosure portion 32 is provided integrally in the male housing 30 so as to enclose front end portions of male terminals (not shown). The presence of the enclosure portion 32 makes it difficult to remove, from the male housing 30, the front holder 40 attached to the male housing 30.

However, as shown in FIG. 16, a guide groove 36 for removing the front holder is formed in a lower surface of an inner wall of the enclosure portion 32 of the male housing 30 so as to extend in the fitting direction. As shown in FIG. 16(*b*) (an enlarged view of a region H in FIG. 16(*a*)), a slope portion 37 that is inclined upward from the lower surface of the inner wall of the enclosure portion 32 (that is, in a direction approaching the front holder 40) is provided in a deepest (rearmost) part of the guide groove 36. Incidentally, illustration of the front holder 40 is omitted in FIG. 16(*b*) for the sake of convenience.

Figure 17A:
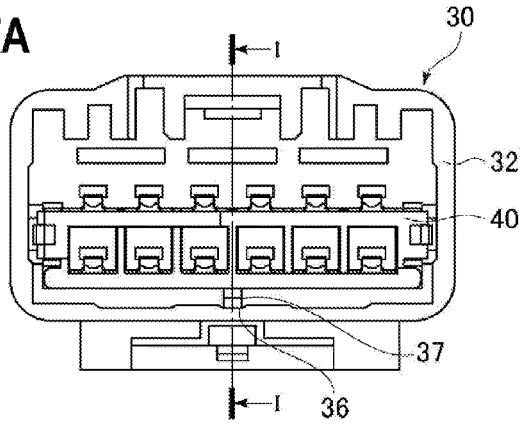
FIGS. 17A to 17C are views for explaining a step of removing the male-side front holder attached to the male housing shown in FIG. 1.
Figure 17B:
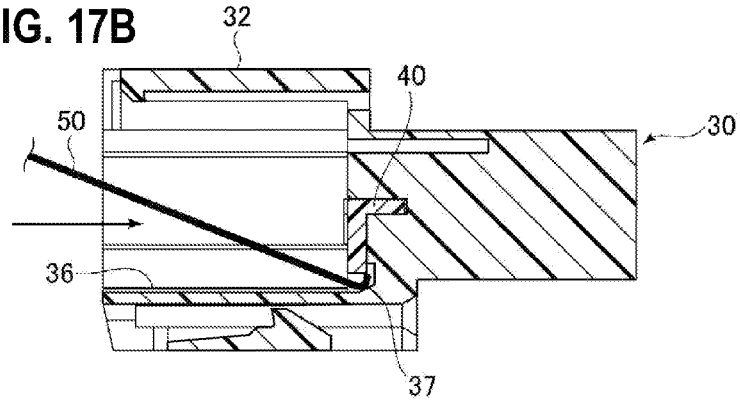
Figure 17C:
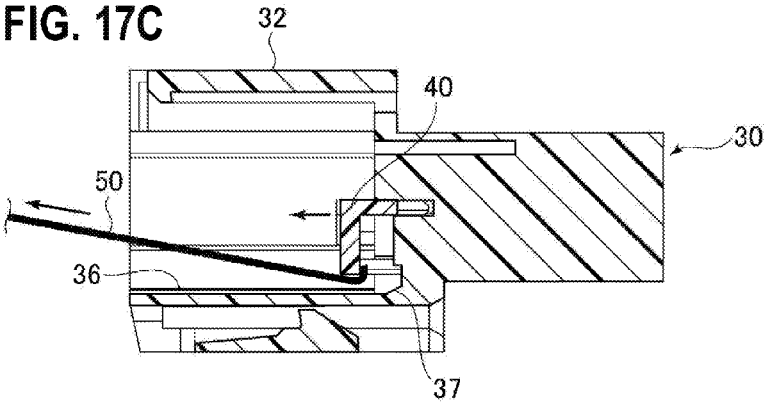

As shown in FIG. 17, when the front holder 40 attached to the male housing 30 is removed from the male housing 30, a front holder separation rod 50 having a rod-like shape with a curved front end portion is used. That is, first, as shown in FIG. 17(*b*), the front holder separation rod 50 is inserted into the guide groove 36 to slide along the guide groove 16 toward the front holder 40 while the front holder separation rod 50 is kept in a direction in which the front end portion thereof is curved upward. As soon as the front holder separation rod 50 reaches the slope portion 37 on the deep side of the guide groove 36, the front holder separation rod 50 is guided by the slope portion 37 to thereby approach the lower surface of the front holder 40.

Then, as shown in FIG. 17(*c*), the front holder separation rod 50 is hooked at a predetermined place of the front holder 40 and pulled out toward the near side (front side). Thus, the front holder 40 can be removed. As a result, the front holder 40 can be removed easily even if the front holder 40 is attached to the male housing 30 located in a deep position far from the opening of the enclosure portion 32.

(Operation and Effect)

According to the connector according to the embodiment of the invention, the ribs 23 of the front holder 20 are received in the groove portions 16 of the housing 10 in the state where the front holder 20 has been attached to the housing 10. Thus, it is possible to suppress moving and twisting of the front holder 20 in the width direction. In addition, the protrusion portions 17 of the housing 10 are in contact with the upper surface of the front holder 20. Thus, it is possible to suppress moving of the front holder 20 in the up/down direction.

In addition, in the state where the front holder 20 has been attached to the housing 10, the protrusion portions 17 of the housing 10 are in contact with the central part of the front holder 20 and the opposite sides thereof in the width direction. Thus, it is possible to prevent the front holder 20 from twisting in the up/down direction.

In addition, each rib 23 has a flat shape in section. It is therefore possible to more surely prevent the front holder 20 from twisting in the width direction. From above, according to the connector according to the embodiment of the invention, it is possible to prevent displacement of the front holder 20 as much as possible.

Further, the front holders 20 and 40 have substantially the same shape. Accordingly, the front holders 20 and 40 can be shared with each other. Thus, the number of components in the connector can be reduced so that management of the components or the like can be made easy during manufacturing of the connector. Further, the manufacturing cost of the pair of front holders can be reduced, and hence the manufacturing cost of the connector can be reduced.

Other Embodiments

Incidentally, the invention is not limited to the aforementioned embodiment, but various modifications can be applied within the scope of the invention. For example, the invention is not limited to the aforementioned embodiment, but changes, improvements, etc. can be made thereon suitably. In addition, materials, shapes, dimensions, numbers, arrangement places, etc. of constituent elements in the aforementioned embodiment are not limited, but any materials, any shapes, any dimensions, any numbers, any arrangement places, etc. may be used as long as the invention can be attained.

For example, in the aforementioned embodiment, a configuration according to the invention (engagement between the ribs 23 and the groove portions 16, and contact of the protrusion portions 17) is applied to both the combination between the female housing 10 and the front holder 20 to which female terminals can be inserted and the combination between the male housing 30 and the front holder 40 to which male terminals can be inserted. However, the configuration may be applied to only one of a combination between a female housing and a female-side front holder to which female terminals can be inserted and a combination between a male housing and a male-side front holder to which male terminals can be inserted.

Further, the ribs 23 and the groove portions 16 are provided at a plurality of places of the front holder 20 and the female housing 10 in the width direction respectively. However, a rib 23 and a groove portion 16 may be provided at only one place of the front holder 20 and the female housing 10 in the width direction. In the same manner, the protrusion portions 17 are provided at a plurality of places of the female housing 10 in the width direction respectively. However, a protrusion portion 17 may be provided at only one place of the female housing 10 in the width direction.

In addition, each rib 23 has a sectionally flat shape long in the fitting direction and short in the width direction in a section perpendicular to the extension direction of the rib 23. However, each rib 23 may have a sectionally flat shape short in the fitting direction and long in the width direction.

Here, the features of the aforementioned embodiment of the connector according to the invention will be summarized and listed briefly in the following paragraphs (1) to (3).

(1) A connector including:

a housing (10, 30) including a terminal reception chamber (11) which is capable of receiving a terminal; and a front holder (20, 40) that is attached to the housing so as to double-lock the terminal in the terminal reception chamber; wherein:

the front holder (20, 40) includes a plate-like rib portion (23) extending in a direction crossing a fitting direction of the front holder;

the housing (10, 30) includes a groove portion (16) and a mountain-like protrusion portion (17) in a mounting position (15) where the front holder is mounted, the groove portion being recessed into a shape that receives the rib portion (23) while supporting the rib portion, the groove portion extending in a direction in which the rib portion extends, the protrusion portion protruding in an extension direction of the groove portion and extending in the fitting direction of the front holder; and when the front holder is attached to the housing, the rib portion (23) is received in the groove portion (16), and the protrusion portion (17) comes in contact with a surface (26) of the front holder.

(2) The connector according to the aforementioned paragraph (1), wherein:

the housing (10, 30) including the protrusion portion (17) further includes other protrusion portions (17) similar thereto, and the protrusion portions are disposed in contact with at least three places of the front holder including a central part in a width direction of the front holder, a part on one end side from the central part, and a part on the other end side from the central part (FIG. 11).

Figure 9B:
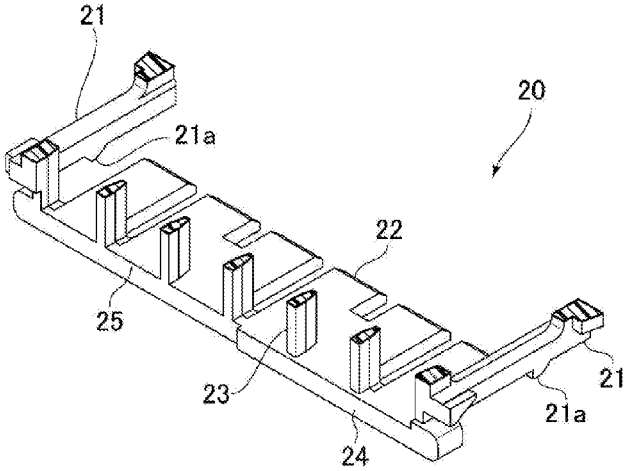

(3) The connector according to the aforementioned paragraph (1) or (2), wherein:

the rib portion (23) has a sectionally flat shape in a section perpendicular to the extension direction of the rib portion, the flat shape being long in the fitting direction and short in the width direction of the front holder (FIG. 9*b*).

What is claimed is:

1. A connector comprising:

a housing that includes a terminal reception chamber that is capable of receiving a terminal; and a front holder that is attached to the housing so as to double-lock the terminal in the terminal reception chamber;

wherein the front holder includes a plate-like rib portion extending in a direction crossing a fitting direction of the front holder, the housing includes a groove portion and a mountain-like protrusion portion in a mounting position where the front holder is mounted, the groove portion being recessed into a shape that can receive the rib portion while supporting the rib portion, the groove portion extending in a direction in which the rib portion extends, the protrusion portion protruding in an extension direction of the groove portion and extending in the fitting direction of the front holder, and when the front holder is attached to the housing, the rib portion is received in the groove portion, and the protrusion portion comes in contact with a surface of the front holder.

2. The connector according to claim 1, wherein the housing including the protrusion portion further includes other protrusion portions similar thereto, and the protrusion portions are disposed in contact with at least three places of the front holder including a central part in a width direction of the front holder, a part on one end side from the central part, and a part on the other end side from the central part.

3. The connector according to claim 1, wherein the rib portion has a sectionally flat shape in a section perpendicular to the extension direction of the rib portion, the flat shape being long in the fitting direction and short in the width direction of the front holder.

4. The connector according to claim 2, wherein the rib portion has a sectionally flat shape in a section perpendicular to the extension direction of the rib portion, the flat shape being long in the fitting direction and short in the width direction of the front holder.

* * * * *